United States Patent [19]

Dreher

[11] Patent Number: 4,522,046

[45] Date of Patent: Jun. 11, 1985

[54] CONTINUOUS BATCH LAUNDRY SYSTEM

[75] Inventor: Adolf E. S. Dreher, Hamburg, Fed. Rep. of Germany

[73] Assignee: Washex Machinery Corporation, Tex.

[21] Appl. No.: 548,477

[22] Filed: Nov. 3, 1983

[51] Int. Cl.[3] ..... D06F 31/00

[52] U.S. Cl. ..... 68/27; 68/140

[58] Field of Search ..... 68/27, 58, 140, 143, 68/145; 134/69, 159; 34/129; 432/106, 115; 51/164.1; 366/235

[56] References Cited

U.S. PATENT DOCUMENTS

| | | | |
|---|---|---|---|
| 1,251,567 | 1/1918 | Potthoff | 134/69 |
| 3,477,704 | 11/1969 | Sherwood | 432/115 X |
| 3,693,639 | 9/1972 | Corbett | 134/159 X |
| 3,869,883 | 3/1975 | Rotter | 68/140 X |
| 3,995,458 | 12/1976 | Grunewald et al. | 68/140 |
| 4,020,659 | 5/1977 | Bhavsar | 68/27 |
| 4,109,493 | 8/1978 | Hugenbruch | 68/27 |
| 4,236,393 | 12/1980 | Katzfey | 68/27 |

*Primary Examiner*—Philip R. Coe

*Attorney, Agent, or Firm*—Hubbard, Thurman, Turner & Tucker

[57] ABSTRACT

A continuous batch laundry system is disclosed which utilizes a plurality of longitudinally aligned modules with an inlet chute at one end and a discharge chute at the other end. Each module includes a stationary shell and a rotatably supported drum or cylinder within the shell. A plurality of support bearings are suspended from within the stationary shell and serve to support each cylinder for oscillatory and rotary movement about a horizontal axis. By utilizing suspended bearings variations in length and alignment due to thermal expansion and contraction may be easily accommodated. Individual cylinders each include a large opening in both spaced apart end walls for receiving and transferring articles between adjacent cylinders. A transfer chute associated with each cylinder is utilized to retain articles within a cylinder during oscillation and to transfer articles into an adjacent successive cylinder in response to rotation of the cylinder. Adjoining cylinders are coupled together utilizing sleeves which extend from each end wall of each cylinder. Each sleeve includes a sprocket gear disposed about the extended end of the sleeve and adjoining sprocket gears are then wrapped with a roller chain to permit rotational torque to be transmitted from one cylinder to another despite minor misalignments between cylinders.

18 Claims, 4 Drawing Figures

CONTINUOUS BATCH LAUNDRY SYSTEM

BACKGROUND OF THE INVENTION

This invention relates in general to continuous batch or "tunnel" laundry machines and in particular to methods and apparatus for coupling individual cylinders within the machine together for oscillation and rotation. Still more particularly, this invention relates to apparatus for coupling individual modular laundry machine cylinders together and suspending those cylinders in a manner which will transmit rotational torque efficiently despite minor misalignments due to loading, foundation shifting or the like.

Certain batch laundry systems are well known in the art and are utilized extensively in commercial laundry applications and in the treatment or washing of textile piece goods. Typically known batch laundry machines include a longitudinally elongated housing which encloses a plurality of chambers which are utilized for prewash, rinse, main wash, boiling or cold rinsing, and other forms of treatment. Generally water is circulated through the machines and recycled from the outlet end back to the inlet end. Drive means are generally provided for oscillating the various chambers to maximize the cleansing action.

Well known batch laundry systems exist which utilize a drum or cylinder which includes a transfer chute which acts to retain the contents of the cylinder during oscillation and serves to transfer the contents to an adjacent cylinder upon unidirectional rotation of that cylinder. Thus, the contents of such a system enter the system at one end and proceed through the various cylinders to exit the system at the other end.

The total number of cylinders within each batch laundry system is adapted to the amount of laundry to be processed and cannot be easily varied utilizing known systems. In large applications it is not uncommon for the entire system to exceed fifty feet in length and to occupy a large amount of space.

Two types of construction are known in batch laundry systems of this description. A first system type, referred to herein as a "rigid" system includes a plurality of drums or cylinders which are rigidly coupled together to form a single element. One example of such a system is disclosed in U.S. Pat. No. 3,995,458, issued to Grunewald et al. The advantage of such known rigid systems is that a single drive motor can be utilized to rotate all of the cylinders within the single element. However, such systems are extremely difficult to deliver and install due to the length and size of the drum and are prone to misalignment problems which can occur due to uneven loading within the cylinder or foundation settling. Such alignment problems often cause binding in the rotational bearing supports of the single drum and it is often necessary to correct this misalignments by utilizing shims or other techniques.

A second type of construction commonly used in batch laundry systems is the so-called "modular" system in which each individual cylinder within the drum is separately supported and driven. Examples of these systems can be seen U.S. Pat. Nos. 4,020,659, issued to Bhavsar; 4,109,493, issued to Hugenbruch; and 4,236,393 issued to Katzfey. While these modular systems are simple to deliver and install their reliability suffers due to the necessity of multiple drive motors for each modular segment. Certain designers have attempted to correct this problem by utilizing a single elongated drive shaft with separate drive belts or gears for each module; however, the necessity of accurate timing relationships between adjacent drums to accomplish near simultaneous transfer of articles from one drum to an adjacent drum all along the system also results in reduced reliability.

It should therefore be apparent that a need exists for a batch laundry system which combines the advantages of simplicity found in rigid systems with the ease of installation and delivery found in modular systems.

SUMMARY OF THE INVENTION

Therefore, it is one object of the present invention to provide an improved batch laundry system.

It is another object of the present invention to provide an improved batch laundry system which can be delivered and installed in modular sections.

It is yet another object of the present invention to provide an improved batch laundry system which can be assembled in modular sections and driven utilizing a common drive unit.

It is another object of the present invention to provide an improved batch laundry system which can be driven utilizing a common drive unit and which is relatively insensitive to misalignment between individual cylinders.

The foregoing objects are achieved as is now described. A continuous batch laundry system is provided which utilizes a plurality of longitudinally aligned modules with an inlet chute at one end and a discharge chute at the other end. Each module includes a stationary shell and a rotatably supported drum or cylinder within the shell. A plurality of support bearings are suspended from within the stationary shell and serve to support each cylinder for oscillatory and rotary movement about a horizontal axis. By utilizing suspended bearings variations in length and alignment due to thermal expansion and contraction may be easily accommodated. Individual cylinders each include a large opening in both spaced apart end walls for receiving and transferring articles between adjacent cylinders. A transfer chute associated with each cylinder is utilized to retain articles within a cylinder during oscillation and to transfer articles into an adjacent successive cylinder in response to rotation of the cylinder. Adjoining cylinders are coupled together utilizing sleeves which extend from each end wall of each cylinder. Each sleeve includes a sprocket gear disposed about the extended end of the sleeve and adjoining sprocket gears are then wrapped with a roller chain to permit rotational torque to be transmitted from one cylinder to another despite minor misalignments between cylinders.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
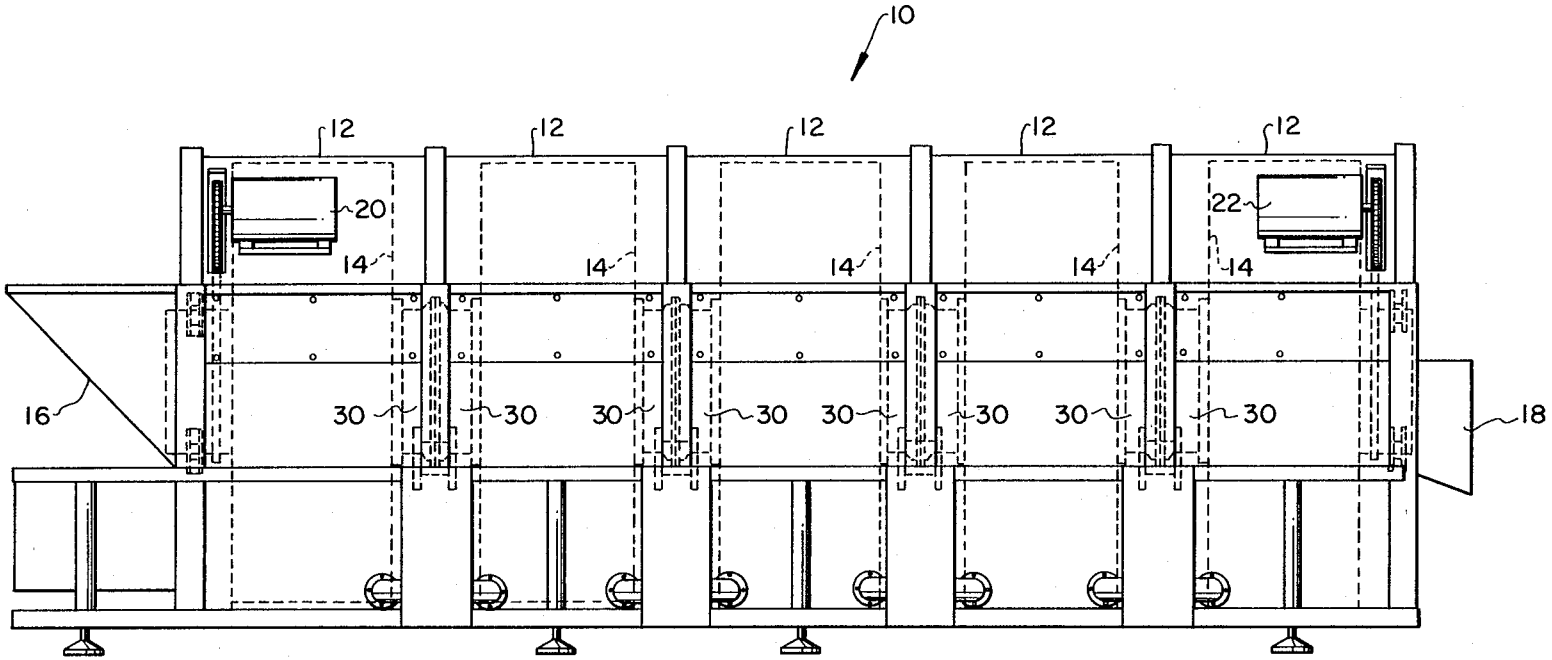
FIG. 1 is a side elevational view of the continuous batch laundry system of the present invention.

With reference now to the figures and in particular with reference to FIG. 1, there is depicted a side elevation view of continuous batch laundry system 10 of the present invention. As can be seen, system 10 includes a plurality of longitudinally aligned modules 12, each of which houses a rotatably supported drum 14. Each drum 14 includes two spaced end walls which each include a large opening to provide communication between adjacent drums. Inlet and outlet to each drum 14 is accomplished through a cylindrical sleeve 30 disposed on each endwall which will be described in detail herein. For the sake of clarity, the connecting piping normally utilized in conjunction with each drum 14 is not shown. As is typical in such systems, an inlet chute 16 is provided for receiving articles of clothing or the like for laundering and after being fully loaded a load of laundry is present in each of the drums 14 depicted. An outlet chute 18 is provided for the removal of each load of laundry after it has completed its cycle through system 10.

The construction of drums 14 and the rest of system 10 is generally accomplished utilizing suitable corrosion resistant materials such as stainless steel and, in the manner described herein, each module 12 can be individually manufactured, shipped and assembled at the installation site. The operation of such batch laundry systems is relatively well known in the art and is generally accomplished utilizing electric drive motors such as those depicted at reference numerals 20 and 22, to provide the oscillatory and rotational movement necessary to operate the system. In the depicted system, four electric drive motors are utilized, two in each endmost module. Preferably, two of the four motors are energized to oscillate drums 14 in one direction, and the remaining two motors are then energized to oscillate drums 14 in the other direction. Also preferably, all four motors are utilized to provide the additional torque required to rotate drums 14. Thus, when drums 14 are coupled together and suspended in the novel manner taught herein, electric drive motors 20 and 22 and 24 and 26 (not shown) can be utilized to selectively oscillate and rotate drums 14 to effectuate a washing or conveying of a load of laundry.

Washing and conveying in systems such as system 10 are generally accomplished by coupling suitable amounts of water and other additives to each drum 14. Drums 14 are then repeatedly oscillated less than one rotation for a selected period of time to provide an agitation which enhances the washing or rinsing action. Each drum 14 is provided with an inclined chute or a ramp (not shown) which is mounted across the drum from the high side of the inlet portion to the low side of the outlet portion of each drum. These chutes or ramps may take various shapes and configurations but all are designed to lift an entire load of laundry out of a drum and convey that load into the next drum upon a full rotation of drum 14. Those skilled in the art will appreciate that as demonstrated in the cited patents, many designs and forms of construction can be utilized to provide this conveying ramp and the selection of a single known design is merely a matter of engineering design choice.

Figure 2:
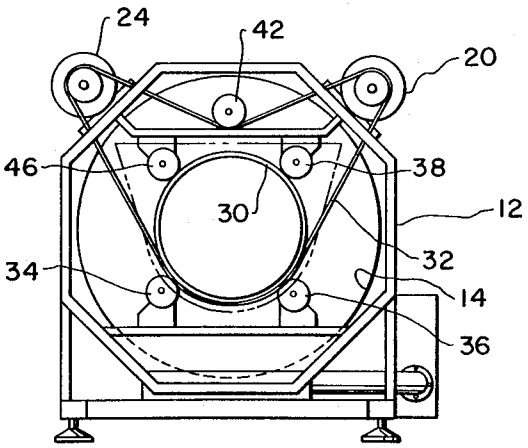
FIG. 2 is a cutaway view of the continuous batch laundry system of FIG. 1 depicting a drive unit of the present invention.

Referring now to FIG. 2, there is depicted a cutaway view of system 10 which depicts a drive unit utilized with the present invention. It should be appreciated, as recited above, that two such drive units are utilized with the preferred embodiment of the present invention, preferably located within the two endmost units of a plurality of longitudinally aligned modules. As can be seen, electric drive motors 20 and 24 (or 22 and 26) are mounted to module 12 and utilized in conjunction with a drive belt or chain 32 to oscillate or rotate drums 14 in the manner described above. Idler sprocket 42 is utilized to tension drive chain 32 and, unlike the novel bearing suspension utilized through each intermediate section of system 10, bearings 34, 26, 38 and 40 are rigidly mounted to module 12 and serve to support cylindrical sleeve 30 at both the inlet and outlet ends of system 10.

Figure 3:
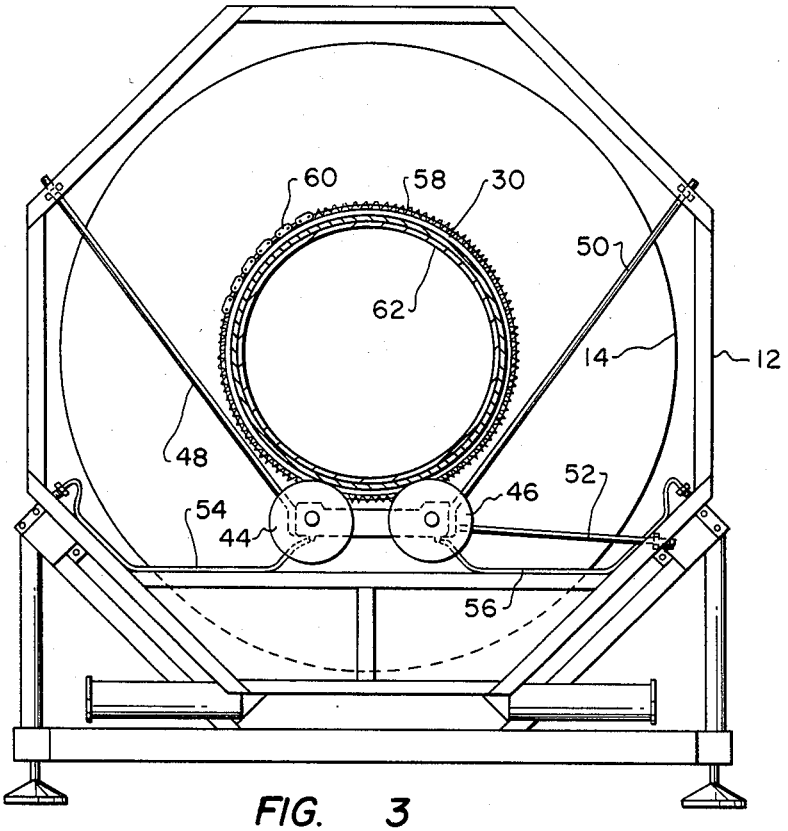
FIG. 3 is a sectional view of the continuous batch laundry system of the present invention depicting the coupling means and suspension system utilized to couple adjacent cylinders therein.
Figure 4:
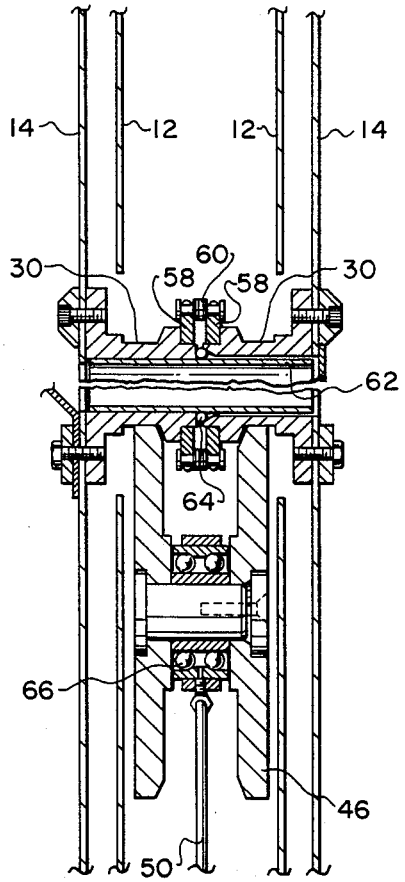
FIG. 4 is a detailed sectional view of the coupling means and suspension system of FIG. 3.

With reference now to FIGS. 3 and 4 there are depicted sectional view of the novel coupling and suspension apparatus of system 10. As can be seen in FIG. 3, each coupling between adjacent modules 12 occurs at the point at which cylindrical sleeves 30 meet. Each cylindrical sleeve 30 includes a sprocket gear 58 disposed about the periphery of its extended end. Thus, when two modules are longitudinally aligned, and cylindrical sleeves 30 are placed in a substantially abutted position, a roller chain 60 can be wrapped around sprocket gears 58 and will serve to couple adjacent drums together in a manner which will effectively transmit rotational torque and which will compensate for minor angular or parallel misalignment between adjacent drums. Also depicted in FIG. 3 is internal liner 62 which extends through cylindrical sleeves 30 from the outlet end wall of one drum 14 to the inlet end wall of a second drum 14, thus providing a relatively waterproof connection from one drum to another.

A second important feature of system 10 which is depicted in FIG. 3 is the utilization of suspension rollers 44 and 46 and the novel manner in which they are mounted. Unlike known batch laundry systems which utilized rollers or bearings fixedly mounted to the base of each modular section, rollers 44 and 46 are literally suspended from the housings of modules 12 utilizing adjustable suspension rods 48, 50 and 52. Preferably rollers 44 and 46 are suspended at each end of modules 12 so that the roller is not within the water zone. In this manner the amount of corrosion on each roller due to water seepage is minimized. Not only does this novel suspension system simplify alignment procedures, but it also greatly reduces misalignment problems which occur as a result of foundation shifting or axial thermal contraction or expansion, since each drum 14 is cradled or suspended from above. Rollers 44 and 46 are preferably lubricated utilizing flexible lubrication lines 54 and 56 to prevent premature failure thereof.

Referring now to FIG. 4, more details of the novel coupling and suspension apparatus of the present invention can be seen. As should be apparent to those skilled in the art, cylindrical sleeve 30 will extend out through each end of module 12 from an end wall of drum 14. Although sleeve 30 is depicted as bolted to the end wall of drum 14 in FIG. 4, those ordinarily skilled in the art will appreciate that cylindrical sleeve 30 may also be welded to the end wall or cast as an integral part thereof. Disposed around the extended periphery of each cylindrical sleeve 30 is a sprocket gear 58 and two adjacent sprocket gears are then coupled together utilizing roller chain 60. An internal liner 62 is provided to minimize water leakage at the joint between adjacent cylindrical sleeves 30 and a resilient member 64 is also utilized to minimize shock loads in this coupling. In a preferred embodiment of the present invention resilient member 64 is provided utilizing an O-ring device and internal liner 62 is preferably fixedly anchored at only one end thereof to permit axial contraction and expansion to take place.

As can be seen in FIG. 4, the coupled cylindrical sleeves 30 are then supported utilizing a plurality of suspension rollers such as roller 46 which is rotatably mounted to a support shaft in any manner well known in the art such as depicted with roller bearing 66. As disclosed above, roller 46 is suspended from the top of module 12 utilizing a plurality of adjustable support rods such as rod 50 and will serve to accommodate a much larger variation in alignment than might otherwise be possible.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A continuous batch laundry system comprising:

a plurality of longitudinally aligned modules having inlet means at one end for receiving articles to be laundered and a discharge means at the other end;

each module including a rotatably supported drum within a housing, said drum being supported for oscillatory and rotary movement about a horizontal axis;

each drum including spaced end walls, each end wall of each drum including a large opening to provide communication between adjacent drums, each drum including means for retaining articles to be laundered during oscillation and for transferring said articles to an adjacent drum during rotation;

a plurality of flexible couplings for coupling adjacent drums together and for transmission of torque for rotation, one drum with another, said plurality of flexible couplings including means for compensating for angular and parallel misalignment between adjacent drums whereby rotation or oscillation of one drum will cause rotation or oscillation of said adjacent drum despite any misalignment; and driving means for inducing rotation and oscillation in at least a selected one of said drums.

2. The continuous batch laundry system according to claim 1 wherein said driving means comprises a first driving motor for imparting oscillation and a second driving motor for imparting rotation.

3. The continuous batch laundry system according to claim 1 wherein said large opening in each end wall of said drum includes a cylindrical sleeve extending therefrom and wherein each of said flexible couplings comprises means for coupling together the extended end of a sleeve from one drum with the extended end of a sleeve from an adjacent drum.

4. The continuous batch laundry system according to claim 3 further including an internal liner extending from the end wall of a first drum to the end wall of an adjacent drum through said coupled cylindrical sleeves.

5. The continuous batch laundry system according to claim 3 wherein each of said cylindrical sleeves includes a sprocket gear disposed about the extended end thereof and where said means for compensating for angular and parallel misalignment betwen adjacent drums includes a roller chain adapted to be wrapped around two adjacent sprocket gears.

6. The continuous batch laundry system according to claim 3 further including resilient means disposed between said coupled extended ends of said adjacent cylindrical sleeves.

7. The continuous batch laundry system according to claim 6 wherein said resilient means comprises an O-ring device.

8. A continuous batch laundry system comprising:

a plurality of longitudinally aligned modules having inlet means at one end for receiving articles to be laundered and a discharge means at the other end;

each module including a rotatably supported drum within a housing, said drum being supported for oscillatory and rotary movement about a horizontal axis;

each drum including spaced end walls, each end wall of each drum including a large opening to provide communication between adjacent drums, each drum including means for retaining articles to be laundered during oscillation and for transferring said articles to an adjacent drum during rotation;

a plurality of flexible couplings for coupling adjacent drums together and for transmission of torque for rotation, one drum with another, said plurality of flexible couplings including means for compensating for angular and parallel misalignment between adjacent drums whereby rotation or oscillation of one drum will cause rotation or oscillation of each drum despite any misalignment; and driving means coupled to the endmost drum at each end of said plurality of longitudinally aligned modules for inducing rotation and oscillation in each of said drums through said coupling means.

9. The continuous batch laundry system according to claim 8 wherein said driving means comprises a first pair of driving motors for imparting oscillation in a first direction and a second pair of driving motors for imparting oscillation in a second direction.

10. The continuous batch laundry system according to claim 8 wherein said large opening in each end wall of said drum includes a cylindrical sleeve extending therefrom and wherein each of said flexible couplings comprises means for coupling together the extended end of a sleeve from one drum with the extended end of a sleeve from an adjacent drum.

11. The continuous batch laundry system according to claim 10 further including an internal liner extending from the end wall of a first drum to the end wall of an adjacent drum through said coupled cylindrical sleeves.

12. The continuous batch laundry system according to claim 10 wherein each of said cylindrical sleeves includes a sprocket gear disposed about the extended end thereof and where said means for compensating for angular and parallel misalignment between adjacent drums includes a roller chain adapted to be wrapped around two adjacent sprocket gears.

13. The continuous batch laundry system according to claim 10 further including resilient means disposed between said coupled extended ends of said adjacent cylindrical sleeves.

14. The continuous batch laundry system according to claim 13 wherein said resilient means comprises an O-ring device.

15. A continuous batch laundry system comprising:

a plurality of longitudinally aligned modules having inlet means at one end for receiving articles to be laundered and a discharge means at the other end;

each module including a rotatably mounted drum within a housing;

support means suspended from within said housings for supporting said drums for oscillatory and rotary movement about a horizontal axis;

each drum including spaced end walls, each end wall of each drum including a large opening having a cylindrical sleeve extending therefrom to provide communication between adjacent drums, each drum including means for retaining articles to be laundered during oscillation and for transferring said articles to an adjacent drum during rotation;

coupling means for coupling together the extended end of a sleeve from one drum with the extended end of a sleeve from an adjacent drum for rotation, one drum with another;

an internal liner extending from the end wall of a first drum to the end wall of an adjacent drum through said coupled cylindrical sleeves;

driving means for inducing rotation and oscillation in at least a selected one of said drums.

16. The continuous batch laundry system according to claim 15 wherein each of said cylindrical sleeves includes a sprocket gear disposed about the extended end thereof and where said coupling means includes a roller chain adapted to be wrapped around two adjacent sprocket gears.

17. The continuous batch laundry system according to claim 15 further including resilient means disposed between said coupled extended ends of said adjacent cylindrical sleeves.

18. The continuous batch laundry system according to claim 17 wherein said resilient means comprises an O-ring device.

* * * * *